United States Patent [19]

Vandevier et al.

[11] Patent Number: 4,678,399

[45] Date of Patent: Jul. 7, 1987

[54] RESISTANT COMPONENTS FOR SUBMERSIBLE PUMP STAGES

[75] Inventors: Joseph E. Vandevier; John L. Bearden; William F. Pranger, all of Claremore, Okla.; Harold L. Miller, Cary, Ill.

[73] Assignee: Hughes Tool Company, Houston, Tex.

[21] Appl. No.: 792,618

[22] Filed: Oct. 23, 1985

Related U.S. Application Data

[63] Continuation of Ser. No. 585,059, Mar. 1, 1984, abandoned.

[51] Int. Cl.[4] ..... F04D 29/62

[52] U.S. Cl. ..... 415/199.2; 415/104

[58] Field of Search ..... 415/172 R, 170 R, 199.2, 415/199.3, 170 A, 104; 308/DIG. 8; 277/DIG. 6

[56] References Cited

U.S. PATENT DOCUMENTS

| | | | |
|---|---|---|---|
| 1,525,884 | 2/1925 | Plummer | 415/172 R |
| 4,029,368 | 6/1977 | Tschirky et al. | 415/170 R |

FOREIGN PATENT DOCUMENTS

| | | | |
|---|---|---|---|
| 494540 | 2/1976 | U.S.S.R. | 415/172 R |
| 806905 | 3/1981 | U.S.S.R. | 415/170 R |

*Primary Examiner*—Robert E. Garrett
*Assistant Examiner*—John Kwon
*Attorney, Agent, or Firm*—James E. Bradley

[57] ABSTRACT

A centrifugal submersible pump has wear resistant features to resist erosion due to sand laden fluid from a well. The pump has diffusers and impellers located within a housing. Wear resistant inserts are secured to the diffusers and impellers. The inserts include inserts with cylindrical surfaces for radial support and sealing, and inserts with flat transverse surfaces for thrust. The inserts are preferably formed of tungsten carbide and are harder than the material of the impellers and the diffusers.

3 Claims, 2 Drawing Figures

RESISTANT COMPONENTS FOR SUBMERSIBLE PUMP STAGES

This application is a continuation-in-part, continuation, of application Ser. No. 585,059, filed 3/1/84 now abandoned.

BACKGROUND OF THE INVENTION

1. Field of the Invention

This invention relates in general to submersible centrifugal pumps, and in particular to wear resistant inserts located in the pump stages for reducing erosion and/or abrasion.

2. Description of the Prior Art

A submersible centrifugal pump assembly of the type concerned herein includes a downhole electric motor coupled to a centrifugal pump. The pump has numerous stages of diffusers and impellers for pumping fluid to the surface from the well. Normally the impellers and diffusers are made from a cast alloy. The impellers rotate within the diffusers, and the mating sliding surfaces are machined smooth to reduce wear and to provide close clearances for sealing. Elastomeric thrust washers may be located between the impellers and diffusers to avoid metal-to-metal contact in the direction of downward and upward thrust.

While these types of pumps are successful, if the fluid being pumped contains a significant amount of entrained sand, the abrasive particles will abrade and/or erode the pump impellers and diffusers, shortening the life of the pump. Normally a pump needs to be pulled from the well for servicing only every twelve to eighteen months. If the sand has abraded the pump components severely, the pump might have to be pulled earlier than the usual life. The cost for pulling the pump, including lost production time, can be quite expensive, particularly with offshore wells.

SUMMARY OF THE INVENTION

In this invention, wear resistant inserts are secured to the impeller and diffuser at points where the impeller and diffuser engage each other in sliding contact or close clearance sealing. These inserts have a surface hardness that is greater than the hardness of the impeller and diffuser, and preferably are formed of solid tungsten carbide or other hard material. The inserts include both the cylindrical surfaces which provide radial support for the impeller and the flat surfaces which transmit downward thrust.

Preferably the impeller has an insert that serves as the balance ring and another insert that serves as the hub. The diffuser preferably has a bore insert that receives the impeller hub and a balance ring bore insert that receives the balance ring insert of the impeller. For downward thrust, the diffuser has on its upper side an annular downward insert with a flat upper surface. Each impeller has a skirt insert on its lower side with a flat surface for transmitting the downward thrust. The skirt also has a depending cylindrical surface that engages a sidewall of the downward insert of the diffuser.

DESCRIPTION OF THE PREFERRED EMBODIMENTS

Figure 1:
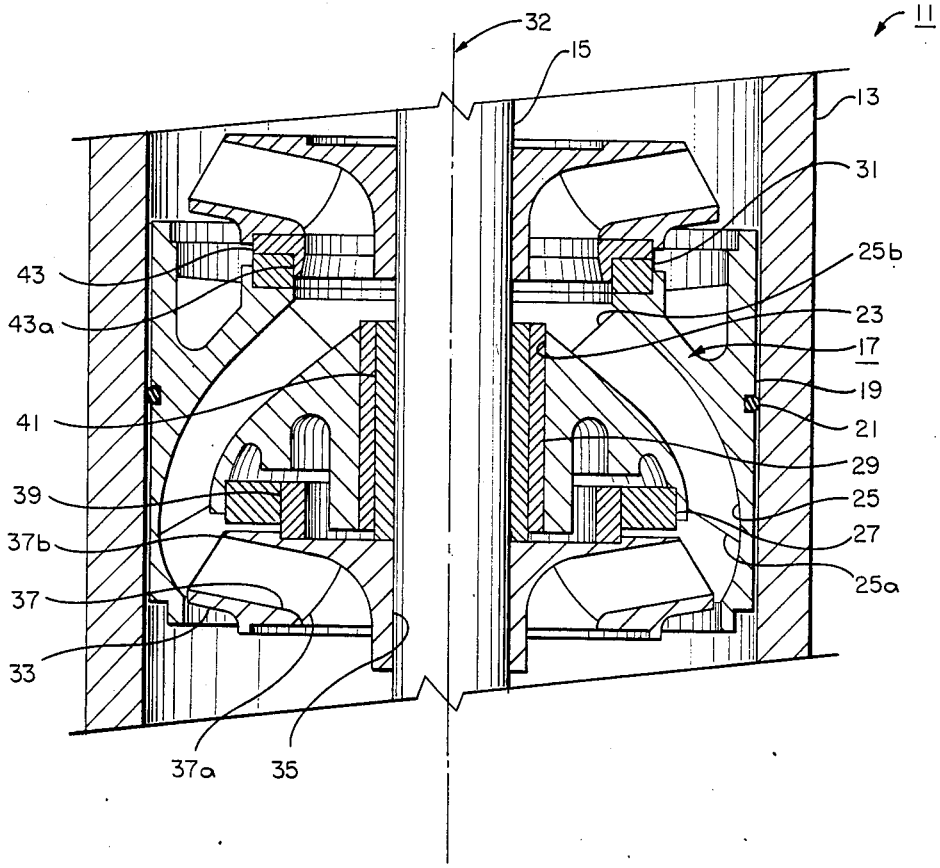
FIG. 1 is a partially sectioned view of a diffuser, two impellers, and the wear resistant inserts for each pump stage constructed in accordance with this invention.

Referring to FIG. 1, pump 11 has a cylindrical housing 13. A shaft 15 extends concentrically through the housing for driving the pump, the shaft being rotated by a submersible electric motor (not shown). The pump 11 has a plurality of pump stages (only one shown), each stage including a diffuser 17. Diffuser 17 is a tubular metal casting having an outer wall 19 that is mounted inside the housing 13 stationarily. An O-ring 21 is located between the outer wall 19 and the housing 13 for sealing. Diffuser 17 is a single piece member having an axial bore 23 that is larger in diameter than the shaft 15. Diffuser 17 has a number of passages 25. Each passage 25 has an inlet **25*a* at the lower side of diffuser 17 and radially outward from bore 23. Each passage 25 spirals slightly upwardly and inwardly to an outlet 25*b* on the upper side of diffuser 17. Outlet 25*b* is located radially inward from the inlet 25*a***.

Each diffuser 17 has a balance ring bore insert 27 secured to it. The balance ring bore insert 27 is an annular member, rectangular in transverse cross-section and located slightly inward from the passage inlets **25*a*. Each balance ring bore insert 27 has a cylindrical inner diameter. A diffuser bore insert 29 is secured concentrically within bore 23. Bore insert 29 is tubular and has a cylindrical inner diameter that is greater in diameter than the shaft 15. A downward thrust insert 31 is secured to the upper side of diffuser 17 immediately outward from the passage outlets 25*b*. The downward thrust insert 31 is also an annular member with a rectangular cross-section, similar to the balance ring bore insert 27. The downward thrust insert 31 has a flat upper surface that is located in a plane perpendicular to the axis 32 of shaft 15**.

Figure 2:
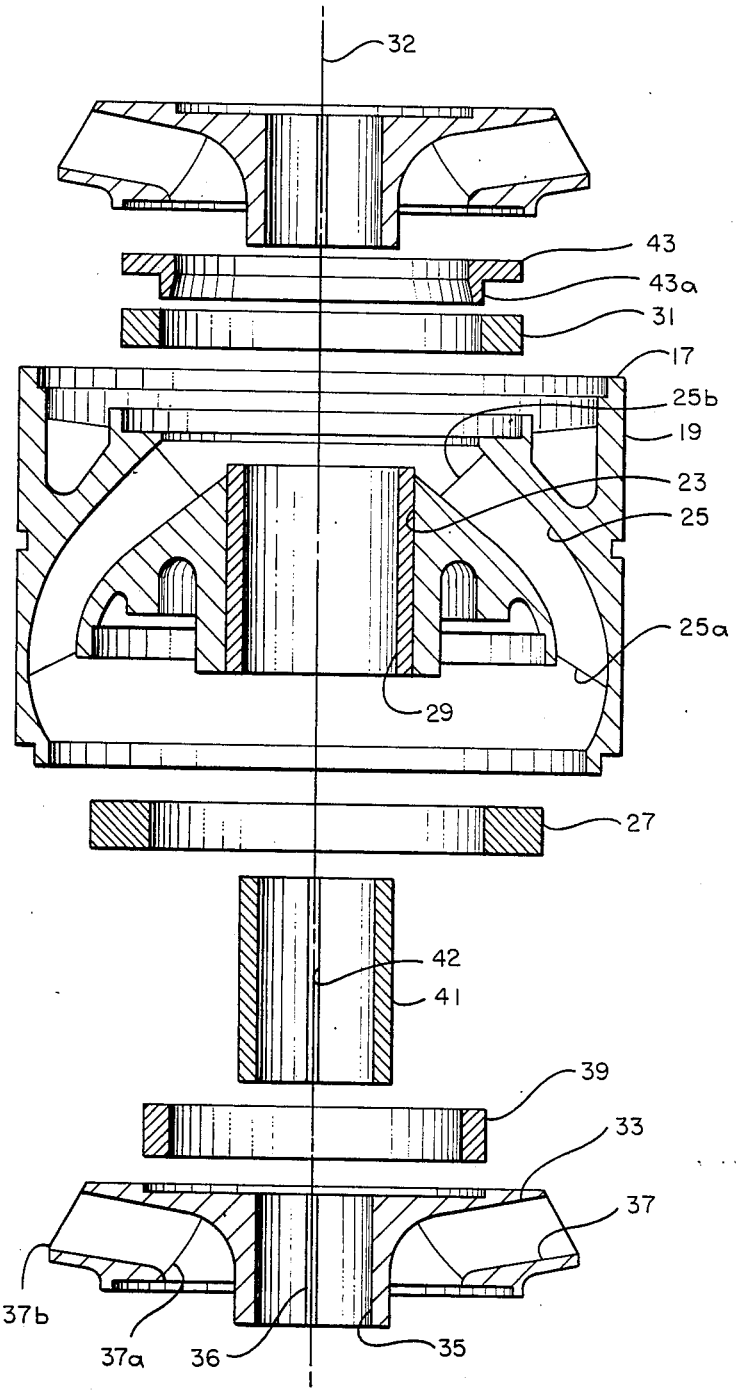
FIG. 2 is an exploded sectional view of the diffuser, impellers, and inserts of FIG. 1.

An impeller 33 (two are shown) is carried by shaft 15 for cooperation with each diffuser 17. Impeller 33 has a bore 35 that is carried by a shaft 15 for rotation therewith by a key (not shown) that engages a vertical slot 36 (FIG. 2). Impeller 33 has a plurality of passages 37 extending therethrough for pumping fluid upwardly. Each passage 37 has an inlet **37*a* and an outlet 37*b*. Outlet 37*b* is located slightly upward from the inlet 37*a* and is located on the periphery of impeller 33. Inlet 37*a* is located radially inward from the periphery of impeller 33**.

A balance ring insert 39 is secured to the upper side of each impeller 33. Balance ring insert 39 is an annular member, rectangular in cross-section. Balance ring insert 39 has an outer diameter that is closely received within the inner diameter of the diffuser balance ring bore insert 27. The inner diameter of the balance ring insert 39 is greater than the diameter of shaft 15. A hub insert 41 is secured to the upper side of each impeller 33 and extends upwardly. Hub insert 41 closely receives shaft 15 and has a slot 42 (FIG. 2) formed in the hub insert 41 for receiving a key (not shown). The outer cylindrical wall of hub 41 is closely received within the inner wall of the diffuser bore insert 29. A skirt insert 43 is secured to the lower side of each impeller 33. Skirt insert 43 is an annular member located immediately outward from the passage inlets **37*a*. Skirt insert 43 has a downwardly facing flat surface that is perpendicular to axis 32 (FIG. 2). Skirt 43 also has a depending integral flange portion 43*a*. Flange portion 43*a* is cylindrical and has an outer diameter that clearance is closely received within the inner diameter of the diffuser downward thrust insert 31. The lower surface of the skirt insert 43 slidingly engages the upper surface of the downward thrust insert 31. For illustration purposes, inserts 39 and 41 are shown attached only to the lower impeller 33 and insert 43 is shown attached only to the upper impeller 33. In practice, all three inserts will be attached to each impeller 33**.

Each diffuser 17 thus has three inserts secured to it, the balance ring bore insert 27, the diffuser bore insert 29 and the downward thrust insert 31. Each of these inserts is closely received within respectively the three impeller inserts, which are the balance ring insert 39, the hub insert 41 and the skirt insert 43. A slight cylindrical clearance exists between the stationary diffuser inserts 27, 29 and 31 and the rotating impeller inserts 39, 41 and 43. Each insert has a surface that is harder and more wear resistant than the base material of either the diffuser 17 or the impeller 33. Preferably, each insert is constructed of solid tungsten carbide or other hard material. The hardness of each insert at its sliding contact surface is approximately 92 Rockwell A. Diffuser 17 and impeller 33 are formed of a cast nickel steel alloy which has a hardness of approximately 45 Rockwell A.

The inserts 27, 29, 31, 39, 41 and 43 may be retained with the diffuser 17 and impeller 33 by various known methods, such as interference fits, adhesives, fasteners, welding or a combination of these methods. In the preferred embodiment, the inserts are retained with their respective components by an epoxy adhesive.

In operation, shaft 15 will be rotated by the electric motor (not shown). Shaft 15 rotates each impeller 33. The balance ring insert 39, hub insert 41 and skirt insert 43 will rotate in unison with each impeller 33. Each diffuser 17 will remain stationary, and along with it each balance ring bore insert 27, diffuser bore insert 29 and downward thrust insert 31.

The outer surface of the balance ring insert 39 will slidingly engage the inner surface of the balance ring bore insert 27. The outer surface of the hub insert 41 will slidingly engage the inner surface of the diffuser bore insert 29. The lower flat surface of the skirt 43 and the flange portion 43*a* will slidingly engage the upper surface of the downward thrust insert 31 and the inner diameter of the downward thrust insert 31. The engagement of the cylindrical surfaces of the balance ring insert 39 with the balance ring bore insert 27, the hub insert 41 with the diffuser bore insert 29, and the skirt flange portion 43 with the inner diameter of the downward thrust insert 31, provide sealing and radial support for the impellers 33. The mating flat surfaces of the downward thrust insert 31 and the skirt insert 43 transmit thrust imposed on the impellers 33. There are no surfaces of the impeller 33 and diffuser 17, other than the insert surfaces, that engage each other in sliding contact.

During rotation of the shaft 15, fluid will enter the inlets 37*a* and be discharged out the outlets 37*b* at a greater velocity. The diffuser passage inlets 25*a* receive the fluid and direct the fluid upwardly and inwardly to be discharged out the passage outlets 25*b* for reception in the next upward impeller 33.

The invention has significant advantages. The wear resistant inserts located at the cylindrical and flat surfaces between the impellers and diffusers reduces the extent of abrasion over the prior art softer metal. Providing the inserts at the points of extreme wear avoids the need for providing an entire impeller or diffuser of expensive, harder material. The inserts should lengthen the life of the pump, and increase the duration between times when the pump must be pulled in sand or abrasive material laden wells.

While the invention has been shown in only one of its forms, it should be apparent to those skilled in the art that it is not so limited but is susceptible to various changes without departing from the scope of the invention.

We claim:

1. In a submersible centrifugal pump of the type having a housing, a drive shaft extending through the housing, a plurality of diffusers mounted stationarily in the housing, each diffuser having a plurality of passages with a lower inlet and an upper outlet, a plurality of impellers, each mounted to the shaft for rotation therewith, each impeller having a plurality of passages with an inlet for receiving fluid from the outlets of an adjacent lower diffuser and an upper outlet for discharging fluid to the inlets of an adjacent upper diffuser, the improvement comprising:

a tungsten carbide skirt insert secured to a lower side of each impeller surrounding the impeller passage inlet, the skirt insert having a downwardly facing flat surface and a flange portion with a cylindrical outer sidewall and depending downwardly from an inner edge of the flat surface, the skirt insert having an inner sidewall that has an upper edge flush with the impeller passage inlet and a lower edge at the lower end of the flange portion, the inner sidewall extending to the lowermost portion of the impeller passage inlet and defining the outer surface of the impeller passage inlet for reducing erosion of the impeller passage inlet;

a tungsten carbide downward thrust insert secured to an upper side of each diffuser surrounding the diffuser passage outlets, located entirely outward of the depending flange portion of the skirt insert, the downward thrust insert having an upwardly facing flat surface that receives the skirt insert downwardly facing flat surface in sliding contact to transmit downward thrust from the impeller, and an inner sidewall that closely receives the outer sidewall of the flange portion of the skirt insert to provide radial support;

a cylindrical balance ring insert of tungsten carbide secured to an upper side of each impeller; and a balance ring bore insert of tungsten carbide secured to a lower side of each diffuser, having a cylindrical inner wall that closely receives an outer wall of the balance ring insert to provide radial support.

2. A submersible centrifugal pump, comprising in combination:

a housing;

a drive shaft extending through the housing;

a plurality of diffusers mounted stationarily in the housing, each diffuser having a bore for receiving the shaft and a plurality of passages with a lower inlet and an upper outlet;

a plurality of impellers, each mounted to the shaft for rotation therewith, each impeller having a plurality of passages with an inlet for receiving fluid from the outlets of an adjacent lower diffuser and an outlet for discharging fluid to the inlets of an adjacent upper diffuser;

a cylindrical hub insert located within each diffuser bore and mounted to the shaft for rotation therewith;

a cylindrical balance ring insert secured to an upper side of each impeller, being of a greater diameter than the hub insert and having a cylindrical outer wall;

an annular skirt insert secured to a lower side of each impeller surrounding the impeller passage inlet, the skirt insert having a flat downwardly facing surface and a flange portion depending downwardly from an inner edge of the flat downwardly facing surface, the flange portion having a cylindrical outer sidewall, the skirt insert having an inner sidewall that has an upper edge flush with the impeller passage inlet and a lower edge at the lower end of the flange portion, the inner sidewall extending to the lowermost portion of the impeller passage inlet and defining the outer surface of the impeller passage inlet for reducing erosion of the impeller passage inlet;

a cylindrical diffuser bore insert secured to each diffuser within the diffuser bore and having an inner wall that closely receives the hub insert;

a balance ring bore insert secured to a lower side of each diffuser, having a cylindrical inner wall that closely receives the outer wall of the balance ring insert to provide radial support; and an annular downward thrust insert secured to an upper side of each diffuser, located entirely outward of the depending flange portion of the skirt insert and having a flat upwardly facing surface that slidingly engages the downwardly facing flat surface that the skirt insert to transmit downward thrust from the impeller, and a sidewall that closely receives the outer sidewall of the flange portion of the skirt insert to provide radial support;

all of the inserts being formed of tungsten carbide.

3. In a submersible centrifugal pump of the type having a housing, a drive shaft extending through the housing, a plurality of diffusers mounted stationarily in the housing, each diffuser having a plurality of passages with a lower inlet and an upper outlet, a plurality of impellers, each mounted to the shaft for rotation therewith, each impeller having a plurality of passages with an inlet for receiving fluid from the outlets of an adjacent lower diffuser and an upper outlet for discharging fluid to the inlets of an adjacent upper diffuser, the improvement comprising:

a tungsten carbide skirt insert secured to a lower side of each impeller surrounding the impeller passage inlet, the skirt insert having a downwardly facing flat surface and a flange portion with a cylindrical outer sidewall and depending downwardly from an inner edge of the flat surface, the skirt insert having an inner sidewall that has an upper edge flush with the impeller passage inlet and a lower edge at the lower end of the flange portion, the inner sidewall extending to the lowermost portion of the impeller passage inlet and defining the outer surface of the impeller passage inlet reducing erosion of the impeller passage inlet; and a tungsten carbide downward thrust insert secured to an upper side of each diffuser surrounding the diffuser passage outlets, located entirely outward of the depending flange portion of the skirt insert, the downward thrust insert having an upwardly facing flat surface that receives the skirt insert downwardly facing flat surface in sliding contact to transmit downward thrust from the impeller, and an inner sidewall that closely receives the outer sidewall of the flange portion of the skirt insert to provide radial support.

* * * * *

UNITED STATES PATENT OFFICE

CERTIFICATE OF CORRECTION

Patent No. 4,678,399 Dated 7/7/87

Inventor(s) RESISTANT COMPONENTS FOR SUBMERSIBLE PUMP STAGES

It is certified that error appears in the above-identified patent and that said Letters Patent are hereby corrected as shown below:

Col. 1, line 5, "continuation-in-part, continuation," should be--continuation--;

Column 5, line 32 "that" should be--of--.

Signed and Sealed this

Twelfth Day of April, 1988

*Attest:*

DONALD J. QUIGG

*Attesting Officer*

*Commissioner of Patents and Trademarks*